US006612278B2

(12) United States Patent
Kampichler

(10) Patent No.: US 6,612,278 B2
(45) Date of Patent: Sep. 2, 2003

(54) ROCKER LEVER FOR VALVE OPERATION OF AN INTERNAL COMBUSTION ENGINE WITH DEVICE FOR AUTOMATIC ADJUSTMENT/READJUSTMENT OF VALVE CLEARANCE

(75) Inventor: Gunter Kampichler, Ruhstorf (DE)

(73) Assignee: Motorenfabrik Hatz GmbH & Co., Ruhstorf (DE)

( * ) Notice: Subject to any disclaimer, the term of this patent is extended or adjusted under 35 U.S.C. 154(b) by 0 days.

(21) Appl. No.: 10/267,106

(22) Filed: Oct. 7, 2002

(65) Prior Publication Data

US 2003/0029404 A1 Feb. 13, 2003

Related U.S. Application Data

(63) Continuation of application No. PCT/EP02/00251, filed on Jan. 12, 2002.

(30) Foreign Application Priority Data

Feb. 8, 2001 (DE) ..... 101 05 807

(51) Int. Cl.[7] ..... F01L 1/18

(52) U.S. Cl. ..... 123/90.45; 123/90.44; 123/90.39

(58) Field of Search ..... 123/90.39, 90.45, 123/90.44

(56) References Cited

U.S. PATENT DOCUMENTS 1,948,063 A * 2/1934 Burkhardt ..... 123/90.45
2,365,401 A * 12/1944 Fisk ..... 123/90.45
2,791,260 A * 5/1957 Pixley ..... 123/90.45

FOREIGN PATENT DOCUMENTS

| | | |
|---|---|---|
| DE | 621 553 | 10/1935 |
| DE | 22 00 131 C2 | 12/1972 |
| DE | 39 01 966 | 8/1989 |
| DE | 43 39 433 | 5/1995 |
| EP | 0 331 901 | 9/1989 |
| FR | 1 207 502 | 2/1960 |
| JP | 63-230916 | 9/1988 |

* cited by examiner

*Primary Examiner*—Thomas Denion
*Assistant Examiner*—Jaime Corrigan
(74) *Attorney, Agent, or Firm*—Katten Muchin Zavis Rosenman

(57) ABSTRACT

A pivoting or rotating mounted rocker arm, for a valve train in an internal combustion engine, fitted with a mechanical valve play adjuster element, for the independent setting/adjustment of a first pre-set valve play between rocker arm and valve stem end. The valve play adjuster element comprises a hollow cylinder mounted in the rocker arm in a rotating manner, with planar surfaces (slide patches) formed around the hollow cylinder circumference and a turning spring which turns the slide patches in a predetermined direction. The independent rotation of the slide patches is prevented by contact of the relevant rear surface edge of the planar surface on the valve stem end, so long as a second given valve play is not reached.

12 Claims, 2 Drawing Sheets

ROCKER LEVER FOR VALVE OPERATION OF AN INTERNAL COMBUSTION ENGINE WITH DEVICE FOR AUTOMATIC ADJUSTMENT/READJUSTMENT OF VALVE CLEARANCE

CROSS REFERENCE TO RELATED APPLICATIONS

This is a continuation under 35 U.S.C. §111(a) of PCT Application PCT/EP02/00251 filed on Jan. 12, 2002.

FIELD OF THE INVENTION

The present invention concerns a rocker lever for the valve operation of an internal combustion engine to actuate the opening of a valve stem against the spring force of a valve spring which closes the valve, being outfitted with a mechanical valve clearance adjusting element.

BACKGROUND OF THE INVENTION

A typical internal combustion engine uses an arrangement of valves to control the intake and exhausting of gases into and out of an engine cylinder. The opening and closing of a valve normally occurs electromagnetically or purely mechanically in that the valve stem is activated by a lever arrangement, which in turn is controlled by a camshaft driven by the crankshaft of the engine. As a rule, the downwardly directed movement of the lever arrangement and the associated activating of the end of the valve stem involves a lifting of the valve head from its seat. This movement is counteracted by the restoring force of an appropriately arranged valve spring, which makes sure that the valve head is pulled back into its tight engagement with the valve seat at the proper time in the engine cycle.

In order to prevent tolerances in the valve operation and temperature fluctuations during the operating of the internal combustion engine from resulting in hard knocking together of valve mechanism and valve stem and also to ensure the secure closing of the valve, it is known how to provide a valve clearance of predetermined (minimum) dimension between valve mechanism and valve stem. However, due to wear and tear, this decreases in size during the operation of the engine, which leads to unwanted changes in the precise valve control required for the operation of the engine and possibly further damage resulting from this.

For this reason, the valve clearance must be adjusted/readjusted to a predetermined magnitude after a corresponding operating time of the engine, which generally involves considerable costs and lengthy down time. Furthermore, this maintenance work requires appropriate technical knowledge and a certain amount of equipment.

One solution might be self-acting systems for automatic adjustment/readjustment of the valve clearance, such as are already known. Very widespread is an automatic hydraulic valve clearance equalization (DE 2200131 C2), in which a pressure space between a cylinder and a piston which can travel therein can be filled with pressurized oil via a check valve, so that the piston interacting with the end of the valve stem can equalize the valve clearance at any time.

However, such hydraulic systems have the drawback that they depend on a supply of pressurized oil from the lubrication system and their response time is dependent on the buildup in oil pressure and the oil viscosity. Furthermore, they are complicated in construction and relatively costly to produce, so that their use in simple internal combustion engines is unsuited.

Mechanically acting valve clearance equalizing devices are also known. DE 43 39 433 A1 describes a valve lever with a deflection device, comprising an adjustment wedge having two wedge surfaces, which is arranged between a supporting wedge secured in position in the direction of adjustment of the adjusting wedge in the valve lever and an adjusting wedge of a valve pressing piece which can move in the direction of the gas exchange valve. With this device, it is possible to substantially reduce the area pressure between the valve pressing piece and its guidance in the valve lever. Also, in EP 0 331 901 A2, a mechanical valve clearance equalization is described in which a rocker interacts with an eccentric disk to eliminate the valve clearance. The eccentricity of the eccentric disk is chosen so that the transmission ratio of the rocker is reduced during the valve actuating stroke, but after the valve returns to its closing position and the transmission forces of the spring disappear, the eccentric disk swivels until the valve clearance is eliminated.

On the other hand, it is desirable to have a purely mechanical and automatically functioning device for adjusting/readjusting the valve clearance, one which is easy and economical to produce.

SUMMARY OF THE INVENTION

This purpose is accomplished by a rocker according to the construction of the present invention. According to the invention, the valve clearance adjusting element mentioned in the introduction is characterized in that it comprises a hollow cylinder, placed and able to turn in the rocker, with flat surfaces (a "sliding block") formed about the circumference of the hollow cylinder, and a torsion spring which turns the sliding block in a predetermined direction of rotation. Adjacent flat surfaces are bounded off from each other by their surface edges.

The torsion spring for turning the sliding block in a predetermined direction of rotation has a much lower spring force than the valve spring which closes the valve, so that the closing of the valve experiences no impairment from a contrary directed force component of the torsion spring.

According to the invention, the sliding block is configured such that the flat surfaces formed about the circumference of the hollow cylinder are each arranged parallel to the axis of the hollow cylinder. This implies that there is a perpendicular to the hollow cylinder axis for each flat surface. This perpendicular coincides in its direction with a radial direction of the circular cross section of the hollow cylinder. According to the invention, the perpendicular through a flat surface to the hollow cylinder axis defines the shortest distance between the flat surface and the hollow cylinder axis. The flat surfaces have surface edges which are parallel to the hollow cylinder axis (and thus also parallel to each other). In relation to the turning of the sliding block in a predetermined direction as produced by the torsion spring, the surface edges of each flat surface that are parallel to the axis of the hollow cylinder are to be distinguished as a leading forward surface edge and a trailing rear surface edge.

The sliding block is characterized in that its flat surfaces have increasing shortest distances from the cylinder axis in the direction opposite the predetermined direction of rotation, as well as an increasing radial distance of the corresponding rear surface edges from the cylinder axis.

According to the invention, furthermore, the flat surfaces each end up in a rotary position to activate the valve stem due to the automatic rotation of the sliding block produced by the torsion spring. In the closing position of the valve and the corresponding position of the rocker, a first predetermined valve clearance results from the difference between the perpendicular distance of the axis of rotation of the hollow cylinder from the end of the valve stem and the shortest distance of the flat surface from the cylinder axis for each rotary position of a flat surface. In the rotary position to actuate the valve stem, within the range of a given valve clearance for each flat surface, spontaneous further turning of the sliding block is precluded by the bearing of the corresponding rear surface edge of the flat surface against the end of the valve stem. Thus, when a rear surface edge is bearing against the end of the valve stem, the spring force of the torsion spring does not produce any turning of the sliding block, but instead a pretensioning of the sliding block in the direction of turning.

In the closing position of the valve and the corresponding position of the rocker, the flat surface is slanted in the position to activate the valve stem by virtue of the torsion spring applying the corresponding rear surface edge against the end of the valve stem. When the valve stem is activated by the tilting of the rocker, this slanting of the flat surfaces with respect to the ends of the valve stem is eliminated and the flat surface then bears fully against the end of the valve stem.

The valve clearance adjusted in this way has a tendency to become enlarged with wear and tear, so that when the valve clearance becomes large enough, the rear surface edge of the flat surface loses its purchase against the end of the valve stem in the rotary position to actuate the valve stem, and then the automatic turning of the sliding block by virtue of the spring force of the torsion spring commences. Of course, the turning can only commence if the flat surface in the position of actuating the valve stem does not bear fully against the end of the valve stem, i.e., only if there exists the appropriately increased valve clearance in the closing position of the valve and the corresponding position of the rocker.

According to the invention, the automatic turning of the sliding block by abutment of the rear surface edge belonging to the flat surface in the position of activating the valve stem is prevented until such time as the valve clearance attains a second predetermined valve clearance, corresponding to the difference between the radial distance of the rear surface edge of the flat surface from the cylinder axis and the shortest distance of this flat surface from the cylinder axis. Wearing of the rear surface edge, which is to be expected in practice will, however, shorten the readjustment interval. Since the perpendicular distance of the rotational axis of the hollow cylinder from the end of the valve stem for a particular position of the rocker lever in the closing position of the valve is essentially constant, it is possible to adjust or readjust a first predetermined valve clearance in terms of the increasing shortest distance of the flat surfaces from the cylinder axis, because each flat surface ends up in the rotary position to activate the valve stem by the automatic turning of the sliding block.

In the basic setting of the sliding block, it is adjusted so that the flat surface ends up in a rotary position to activate the valve stem with the smallest shortest distance from the axis of the hollow cylinder. This adjusts the first predetermined valve clearance. Preferably, the rocker lever is configured such that the torsion spring is a twice-supported helical spring arranged about the axis of the hollow cylinder, having a rigid bearing on the sliding block and the other rigid bearing on the rocker. This simplifies the construction, saves space and is economical.

An advantageous embodiment of the invention calls for the rocker lever to be outfitted with at least four flat surfaces, so that the adjustment/readjustment of the first predetermined valve clearance can be accomplished at least four times.

Furthermore, it is preferable that the first predetermined valve clearance be identical for each flat surface in its rotary position to activate the valve stem. This achieves a repeated readjustment of the valve clearance to the identical predetermined value. In particular, for example, a constant minimum valve clearance can be adjusted for each readjustment stage.

Likewise, it is preferable that the second predetermined valve clearance be identical for each flat surface in its rotary position to activate the valve stem. This ensures that a particular valve clearance which is always the same for each flat surface in the rotary position to active the valve stem is not exceeded. In combination with a constant first predetermined valve clearance, the valve clearance can thus be kept within the bounds defined by the first and second predetermined valve clearance.

In preferred fashion, the first predetermined valve clearance lies in the range of 0.01 mm to 1 mm; preferably, this is 0.1 mm. In preferred manner, the second predetermined valve clearance has a difference from the first predetermined valve clearance which lies in the range of 0.05 mm to 1 mm; preferably, this is 0.2 mm.

An advantageous embodiment of the invention specifies that the flat surfaces of the sliding block are bounded on either side by shim disks mounted on the hollow cylinder. In this way, the sliding block can be easily and at the same time effectively secured in its rotary mounting in the rocker lever as regards its deflection in the direction of the rotary axis, without impairing the automatic turning of the sliding block.

Furthermore, according to the invention, it is preferable that the second predetermined valve clearance of the flat surface with the largest shortest distance, i.e., that flat surface which is the last to engage in the rotary position for activating the valve stem, be chosen large enough to ensure the bearing of the rear surface edge for an average operating life of the internal combustion engine. In this way, the flat surface with the largest shortest distance from the axis of the hollow cylinder, i.e., the one with the maximum ability to equalize the wear and tear over time, will be permanently utilized for the remaining lifetime of the engine.

Preferably, the sliding block is made from chill casting, sintered material, cold-pressed or extruded molded steel.

As already mentioned, the device according to the present invention is easy and economical to produce. However, a special advantage of the invention is that it requires very little room and is almost universally applicable. Moreover, already fabricated internal combustion engines which employ a rocker lever can be easily and economically retrofitted by replacing the current rocker lever with that of the invention.

BRIEF DESCRIPTION OF THE DRAWINGS

In the following, the invention shall be presented as an example making reference to the enclosed drawings.

DETAILED DESCRIPTION OF THE INVENTION

Figure 1:
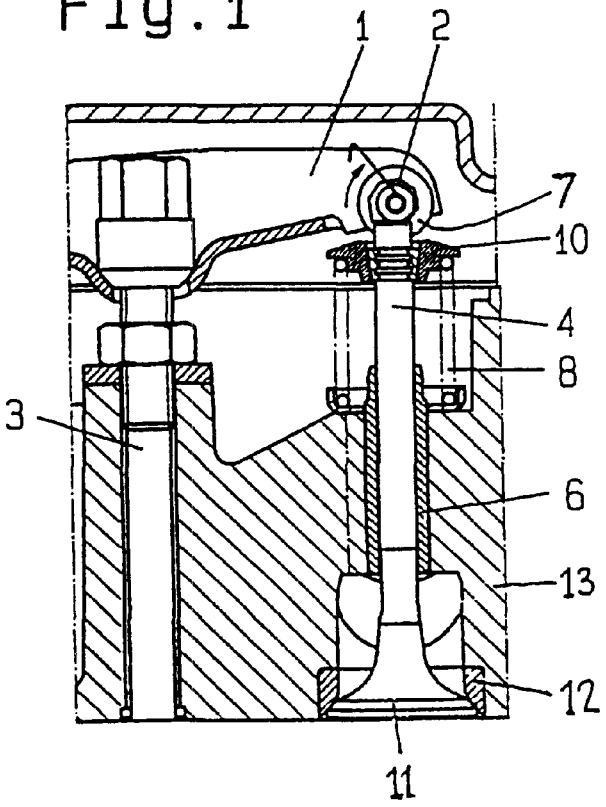
FIG. 1 shows in perspective view a rocker lever according to the invention engaging with a valve stem.

As can be seen from FIG. 1, a rocker lever 1 according to the invention engages with the end of a valve stem 4 by a sliding block 2. The valve stem 4 can move in a guide 6. The valve stem 4 is pressed by a valve spring 8 into a position in which the valve head 11 engages tightly with the valve ring 12. The valve spring 8 is supported at one end against the cylinder head 13 and at the other end against a projection 10 fastened to the valve stem. The rocker 1 is fastened to the engine block by a stem 3. The sliding block 2 can rotate in an appropriate recess between shim disks 7 at one end of the rocker lever 1. A rigid bearing of a torsion spring 5 for turning the sliding block 2 is located at the upper margin of the rocker 1.

In the basic adjustment of the sliding block 2, the flat surface of the sliding block with the smallest shortest distance, i.e., the shortest perpendicular of the particular flat surface with respect to the axis of the hollow cylinder, engages with the end of the valve stem. In the closing position of the valve and the corresponding position of the rocker lever 1, the valve clearance is present between each flat surface in the rotary position to activate the end of the valve stem and the valve stem. Thanks to the automatic turning of the sliding block 2 produced by the spring force of the torsion spring 5, the flat surface located in the activating position is slanted to the end of the valve stem.

When the rocker 1 is tilted to open the valve, its end outfitted with the sliding block 2 moves clockwise downward and at the same time activates the end of the valve stem engaging with the sliding block 2. In this movement, the rocker 1 must first cover the distance of the valve clearance before the flat surface bears fully against the end of the valve stem.

If the valve is closed again at a suitable moment of the engine cycle, i.e., the valve head is pulled back into its tight engagement with the valve ring in the cylinder head, the rocker 2 tilts counterclockwise back to its starting position and the valve stem 4 follows this movement by virtue of the spring force of the valve spring 8, though not losing the engagement with the flat surface of the sliding block 2.

In the end position of the rocker 1, its end outfitted with the sliding block 2 once again has a distance from the end of the valve stem to enable the valve clearance between the flat surface engaging with the end of the valve stem and the end of the valve stem.

The flat surface remains engaged with the end of the valve stem for as long as the trailing rear surface edge in the direction of turning of the sliding block 2 bears against the end of the valve stem. The sliding block 2 is merely preloaded by the torsion spring 5 in this condition.

If the valve clearance increases in the course of the operating life of the engine, the valve clearance can become large enough to reach the value of the second predetermined valve clearance, in which the rear surface edge no longer bears against the end of the valve stem. The sliding block by virtue of the preloading spring force of the torsion spring will then rotate until the next flat surface ends up in the rotary position to active the valve stem by abutment of its rear surface edge. The originally increased valve clearance is once again reduced by the comparatively larger shortest distance of the flat surface and is adjusted to the first predetermined valve clearance.

As soon as the valve clearance in the first stage reaches the value of 0.3 mm, for example, the sliding block rotates to the next surface stage and one immediately gets the starting valve clearance of 0.1 mm, for example, again. Thus, a minimum valve clearance always exists and the valves do not remain open.

Figure 2A:
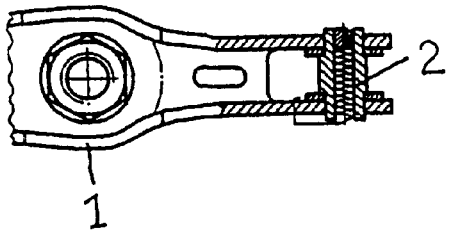
FIG. 2*a* shows in top view a portion of the rocker according to the invention.
Figure 2B:
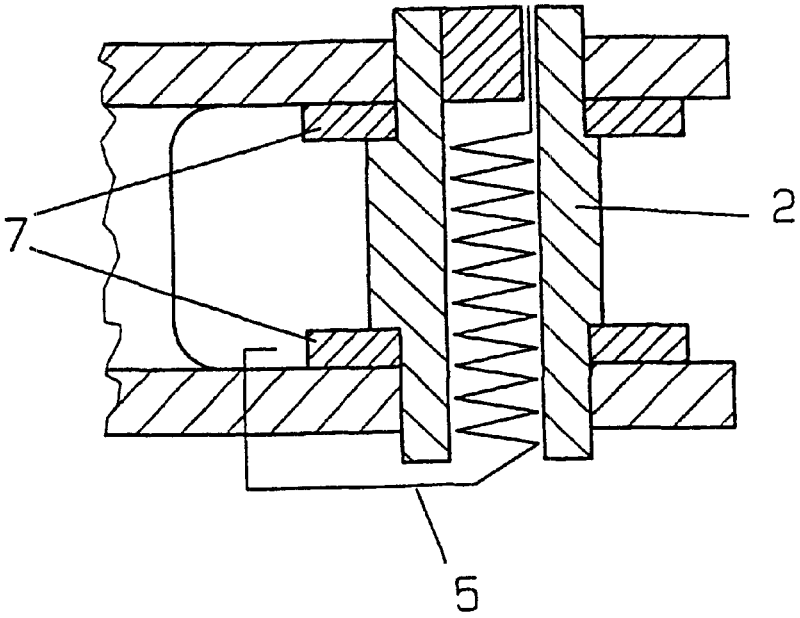
FIG. 2*b* shows in top view an enlarged segment of the invented rocker of FIG. 2*a;*

FIGS. 2*a* and 2*b* each show a top view of the rocker 1 outfitted with the sliding block 2. The torsion spring 5 is visible as a helical spring arranged in the center, having one rigid bearing on the sliding block 2 and the other rigid bearing in a clasping of the rocker 1. The sliding block 2 has the shape of a hollow cylinder with flat surfaces formed about its circumference. The torsion spring 5 is arranged in the hollow center of the cylinder. Furthermore, the sliding block is outfitted with two shim disks 7 arranged on either side of the flat surfaces in order to adjust its moveable bearing arrangement.

Figure 3:
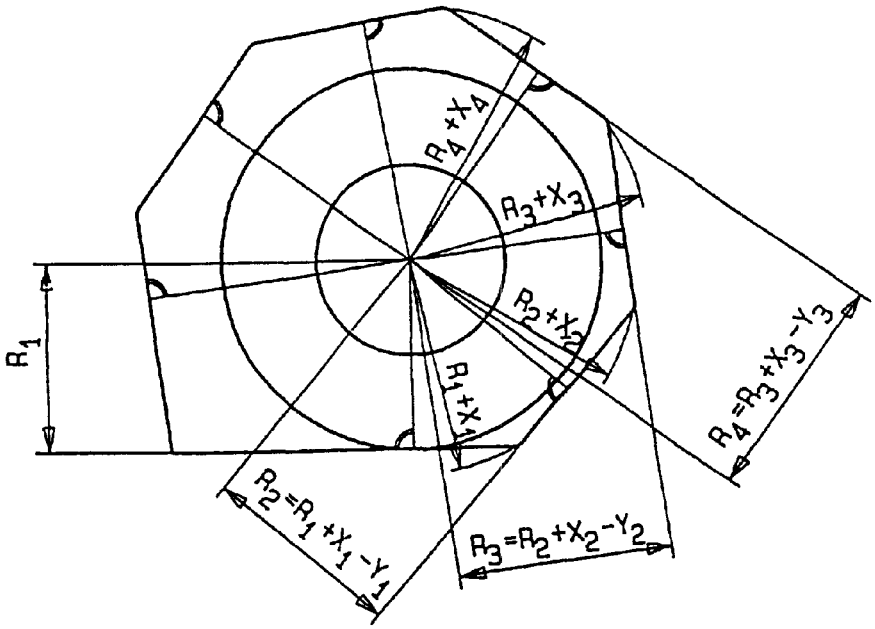
FIG. 3 shows a cross sectional view of a first example of the sliding block with seven flat surfaces.

FIG. 3 shows the sliding block 2 in cross section. The direction of the turning of the sliding block produced by the torsion spring 5 is indicated by the arrow. The hollow cylinder of the sliding block has radius $R_1$ in its circular cross section. About the circumference of the hollow cylinder there are formed the flat surfaces, likewise shown in cross section. The cross section lines of the flat surfaces form an enclosed polygon about the circumference of the hollow cylinder, which is increasingly further away from the circumferential surface counter to the indicated direction of turning. Only the cross section line with the shortest perpendicular radial distance from the axis of rotation touches the circumferential surface of the hollow cylinder. This cross section line and its corresponding flat surface of the sliding block is adjusted in the initial basic setting of the sliding block to activate the end of the valve stem. The perpendicular radial distance of the cross section lines from the axis of the hollow cylinder corresponds to the perpendicular of the flat surface to the axis of the hollow cylinder.

The first predetermined valve clearance results from the difference between the perpendicular distance of the turning axis of the hollow cylinder from the end of the valve stem and the shortest distance of the flat surface from the axis of the cylinder. In the basic setting of the sliding block, the first predetermined valve clearance thus lies within the difference between $R_1$ and $R_1+x_1$.

The second predetermined valve clearance corresponds to the difference between the radial difference of the rear surface edge of the flat surface from the axis of the cylinder and the shortest distance of the flat surface from the axis of the cylinder. In the basic setting of the sliding block, the second predetermined valve clearance thus comprises $x_1$.

As long as the valve clearance has not reached the full difference between $R_1$ and $R_1+x_1$, i.e., $x_1$, the spontaneous turning of the sliding block is prevented by the rear surface edge being applied against the end of the valve stem.

As soon as the valve clearance has reached the value of $x_1$, the sliding block jumps into the next detent position, in which the next flat surface in the direction opposite the direction of turning comes into engagement with the end of the valve stem. The shortest distance of the flat surface from the axis of turning now comprises $R_2=R_1+x_1-y_1$. In this position of the sliding block, the first predetermined valve clearance lies within the difference between $R_2=R_1+x_1-y_1$ and $R_2+x_2$. The second predetermined valve clearance comprises $x_2$.

As long as the valve clearance has not reached the full difference between $R_2=R_1+x_1-y_1$ and $R_2+x_2$, i.e., $x_2$, the spontaneous turning of the sliding block is prevented by the rear surface edge being applied against the end of the valve stem.

As soon as the valve clearance has reached the value of $x_2$, the sliding block jumps into the next detent position, in which once again the next flat surface in the direction opposite the direction of turning comes into engagement with the end of the valve stem. The shortest distance of the flat surface from the axis of turning now comprises $R_3=R_2+x_2-y_2$.

In this position of the sliding block, the first predetermined valve clearance lies within the difference between $R_3=R_2+x_2-y_2$ and $R_3+x_3$. The second predetermined valve clearance comprises $x_3$. As long as the valve clearance has not reached the full difference between $R_3=R_2+x_2-y_2$ and $R_3+x_3$, i.e., $x_3$, the spontaneous turning of the sliding block is prevented by the rear surface edge being applied against the end of the valve stem.

As soon as the valve clearance has reached the value of $x_3$, the sliding block jumps into the next detent position, in which the next flat surface in the direction opposite the direction of turning then enters into engagement with the end of the valve stem. A similar treatment applies to all other flat surfaces. The number of stages can be chosen as needed. For example, a wear of 1 mm can be compensated without problems. FIG. 3 shows 7 stages or edges as an example.

Figure 4:
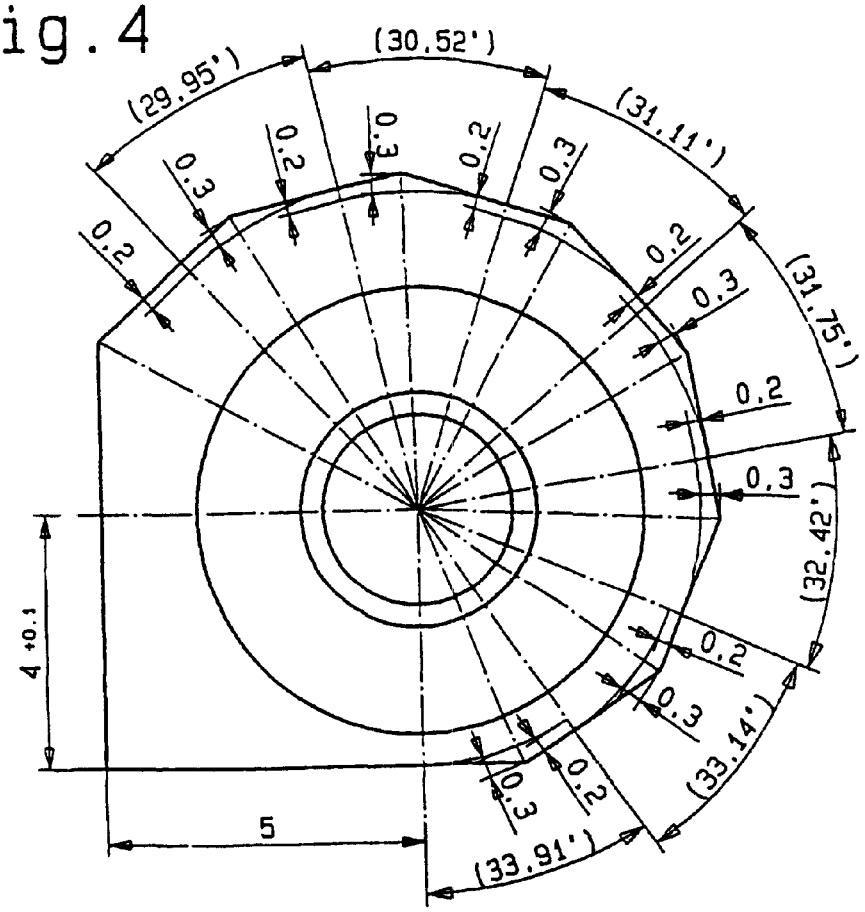
FIG. 4 shows a cross sectional view of a second example of the sliding block with nine flat surfaces.

FIG. 4 shows a second example of the sliding block according to the invention with nine flat surfaces. For clarity, a precise layout of the sliding block is shown here. The first and second predetermined valve clearances are identical for each flat surface. The first predetermined valve clearance is 0.1 mm. Each time that the next flat surface takes up the rotary position to activate the valve stem, the first predetermined valve clearance of 0.1 mm is readjusted. In the basic setting, a valve clearance of 0.1 mm is set. The second predetermined valve clearance is 0.3 mm. The difference between the second predetermined valve clearance and the first predetermined valve clearance is 0.2 mm. Each flat surface after a wear of 0.2 mm clicks into the rotary position to activate the valve stem and reduces the actual valve clearance from 0.3 mm to 0.1 mm once again. In addition, the angles between the adjacent perpendiculars through the flat surfaces onto the axis of the hollow cylinder are indicated.

In this example, the hollow cylinder has a length of 14.4 mm, an outer diameter of 7 mm and an inner diameter of 3.7 mm. The flat surfaces have a width of 6 mm along the axis of the hollow cylinder. The length of the hollow cylinder at either end of the region occupied by flat surfaces is 4.2 mm each.

With the invented rocker lever, outfitted with the device for adjusting/readjusting the valve clearance according to the present examples, one can achieve an average service life of 5000 hours until the last flat surface clicks into the turning position to activate the valve stem. The rear surface edge of the last flat surface is designed so that the activating of the valve stem continues to be done by the last flat surface during the remaining average operating time of the engine.

In the examples shown, seven and nine flat surfaces have been depicted for adjusting/readjusting the valve clearance. In theory, much shorter flat surfaces with shorter readjustment intervals are also conceivable, even to the extent of an approximate spiral formed by flat surfaces; the latter assumes that friction will prevent slippage. There will then constantly exist a bearing of the line, similar to the bearing of the stopping surfaces. Here, again, the wearing down of the rear edge will shorten the readjustment interval.

I claim:

1. Rocker lever for a valve mechanism of an internal combustion engine to open and actuate a valve stem (4) against the spring force of a valve spring (8) closing the valve, outfitted with a mechanical valve clearance adjustment element, said valve clearance adjustment element comprises a sliding block (2) turnable in the rocker lever (1), in the form of a hollow cylinder with and axis and flat surfaces formed about the circumference of the hollow cylinder, and a torsion spring (5) turning the sliding block (2) in a predetermined direction of rotation, wherein:

a) the flat surfaces are each arranged parallel to the axis of the hollow cylinder and the perpendicular to the particular flat surface through the axis of the hollow cylinder corresponds to the shortest distance of the flat surface from the axis of the hollow cylinder, b) the flat surfaces each have a leading front surface edge and a trailing rear surface edge in the predetermined direction of turning, which are parallel to the axis of the hollow cylinder, c) the flat surfaces each have shortest distances from the cylinder axis increasing in the direction counter to the predetermined direction of turning and an increasing radial distance of the respective rear surface edges from the axis of the cylinder, d) the flat surfaces, as a result of the spontaneous turning of the sliding block (2), each end up in the next rotary position to activate the valve stem in which a first predetermined valve clearance results from the difference between the perpendicular distance of the axis of turning of the hollow cylinder from the end of the valve stem and the shortest distance of the flat surface from the cylinder axis, wherein the spontaneous turning of the sliding block (2) is prevented by the rear edge of the flat surface being applied against the end of the valve stem until such time as a second predetermined valve clearance is reached, which is larger than the first predetermined valve clearance and which corresponds to the difference between the radial distance of the rear edge of the flat surface from the cylinder axis and the shortest distance of the flat surface from the cylinder axis.

2. Rocker lever according to claim 1, wherein the torsion spring (5) is a two-bearing helical spring arranged about the axis of the hollow cylinder, having one rigid bearing on the sliding block (2) and the other rigid bearing on the rocker lever.

3. Rocker lever according to claim 1, wherein the sliding block (2) has at least four flat surfaces.

4. Rocker lever according to claim 1, wherein the first predetermined valve clearance is the same for each flat surface in its position of rotation to activate the valve stem (4).

5. Rocker lever according to claim 1, wherein the second predetermined valve clearance is the same for each flat surface in its position of rotation to activate the valve stem (4).

6. Rocker lever according to claim 1, wherein the first predetermined valve clearance lies in the range of 0.01 mm–1 mm.

7. Rocker lever according to claim 1, wherein the second predetermined valve clearance has a difference from the first predetermined valve clearance which lies in the range of 0.01 mm–1 mm.

8. Rocker lever according to claim 1, wherein the flat surfaces of the sliding block (2) are bounded on both sides by shim disks mounted on the hollow cylinder.

9. Rocker lever according to claim 1, wherein the second predetermined valve clearance of the flat surface with the largest shortest distance is chosen large enough to guarantee the abutment of the rear surface edge for an average service life of the internal combustion engine.

10. Rocker lever according to claim 1, wherein the sliding block (2) is made from one of chilled casting, sintered material, cold-pressed or extruded molded steel.

11. Rocker lever according to claim 1, wherein the first predetermined valve clearance is 0.1 mm.

12. Rocker lever according to claim 1, wherein the second predetermined valve clearance has a difference from the first predetermined valve clearance which is 0.2 mm.

* * * * *